US006951500B2

(12) United States Patent
Stacklies

(10) Patent No.: US 6,951,500 B2
(45) Date of Patent: Oct. 4, 2005

(54) WORKPIECE-SURFACE PROCESSING HEAD

(75) Inventor: Siegfried Stacklies, Abtsgmuend (DE)

(73) Assignee: Carl Zeiss SMT AG, Oberkochen (DE)

( * ) Notice: Subject to any disclaimer, the term of this patent is extended or adjusted under 35 U.S.C. 154(b) by 0 days.

(21) Appl. No.: 10/418,635

(22) Filed: Apr. 18, 2003

(65) Prior Publication Data

US 2004/0116049 A1 Jun. 17, 2004

(30) Foreign Application Priority Data

Apr. 23, 2002 (DE) ..... 102 18 039

(51) Int. Cl.[7] ..... B24B 1/00

(52) U.S. Cl. ..... 451/5; 451/164; 451/166; 451/240; 451/255; 451/256

(58) Field of Search ..... 451/5, 164, 166, 451/240, 255, 256, 277, 323, 150, 157, 139, 42; 901/41; 15/124; 65/37; 351/177; 359/819

(56) References Cited

U.S. PATENT DOCUMENTS

| | | | | | |
|---|---|---|---|---|---|
| 4,268,999 | A | | 5/1981 | Noto et al. | |
| 4,956,944 | A | * | 9/1990 | Ando et al. | 451/5 |
| 5,138,798 | A | * | 8/1992 | Volat | 165/77 |
| 5,144,774 | A | * | 9/1992 | Conboy | 451/356 |
| 5,185,957 | A | * | 2/1993 | Mizuguchi et al. | 451/11 |
| 5,449,312 | A | | 9/1995 | Lisec | |
| 5,895,311 | A | * | 4/1999 | Shiotani et al. | 451/5 |
| 5,938,381 | A | * | 8/1999 | Diehl et al. | 409/132 |
| 6,074,281 | A | * | 6/2000 | Swanson et al. | 451/42 |
| 6,200,205 | B1 | * | 3/2001 | Yiu | 451/178 |
| 6,217,496 | B1 | | 4/2001 | Lindem | |
| 6,276,994 | B1 | * | 8/2001 | Yoshida et al. | 451/41 |
| 6,733,369 | B1 | * | 5/2004 | Stacklies et al. | 451/42 |
| 6,769,969 | B1 | * | 8/2004 | Duescher | 451/59 |

FOREIGN PATENT DOCUMENTS

| | | |
|---|---|---|
| DE | 3409300 | 12/1984 |
| DE | 298 03 158 U1 | 9/1998 |
| DE | 197 51 750 A1 | 6/1999 |
| FR | 2 695 855 | 3/1994 |
| WO | WO 00/32353 | 6/2000 |

* cited by examiner

*Primary Examiner*—George Nguyen
(74) *Attorney, Agent, or Firm*—Welsh & Katz, Ltd.

(57) ABSTRACT

A workpiece-surface processing head has at least one processing tool which comes into contact with the surface to be processed and whose longitudinal axis is oriented essentially perpendicularly to the surface to be processed. The processing tool, for processing the workpieces, can be traversed by means of at least one drive device in a direction (X; Y) running at least approximately perpendicularly to its longitudinal axis.

10 Claims, 4 Drawing Sheets

WORKPIECE-SURFACE PROCESSING HEAD

BACKGROUND OF THE INVENTION

1. Field of the Invention

The invention relates to a workpiece-surface processing head of the type defined in more detail in the preamble of claim 1. The invention also relates to a workpiece-surface processing apparatus and to a workpiece-surface processing method.

2. Description of the Related Art

DE 197 51 750 A1 discloses a processing head of the generic type or a tool and also a method and an apparatus for producing optical lenses. In this case, the apparatus is able to adjust or move a plurality of spindles to which the processing heads or tools are attached in the x, y and z directions.

DE 298 03 158 U1 describes a multi-spindle polishing machine having various polishing tools. In this case, the polishing tool is in each case guided on a predetermined path over the area to be polished, the processing head or the polishing layer, that is to say that part of the processing head which is responsible for the actual processing, being rigid relative to the entire processing head.

The disadvantage of these processing heads or of the method carried out with these processing heads consists in the fact that, due to the inevitably regular traveling over the area to be processed along certain paths, correspondingly regular structures are produced on the surface, which, however, is a factor which is extremely problematic, in particular in the case of mirror or lens surfaces which are to be used in lithographic systems, since, for example, scattered light effects are produced in this way.

SUMMARY OF THE INVENTION

It is therefore the object of the present invention to provide a workpiece-surface processing head with which it is possible to produce irregular structures on the surface during the processing.

According to the invention, this object is achieved by the features mentioned in claim 1.

By the at least one drive device which is provided according to the invention and by means of which the processing tool can be traversed perpendicularly to its longitudinal axis, the processing tool can be traversed or adjusted independently of an apparatus to which the workpiece-surface processing head is attached, and can thus be traversed or adjusted very quickly in any desired varying manner, as a result of which the production of regular structures is prevented. In this case, a rotary movement of the workpiece-surface processing head is not necessarily provided.

The structures on the surface of the workpiece which are produced by the workpiece-surface processing head according to the invention are therefore very irregular and purely random, as a result of which lock-in effects are avoided and appropriate workpieces can be produced, especially for highly accurate applications in optics.

A further advantage of the solution according to the invention lies in the fact that a uniform processing speed is obtained over the entire processing region of the workpiece-surface processing head, a factor which leads to a further improvement in the surface quality.

If, in a very advantageous development of the invention, at least one second drive device is provided, by means of which the processing tool can be traversed together with the first drive device in a plane running at least approximately perpendicularly to the longitudinal axis of the processing tool, it is possible for the processing tool in direct contact with the surface to be processed to be adjusted or traversed in any desired directions and within the shortest time, so that completely irregular structures can be created on the surface, which leads to a greatly improved surface roughness overall.

If, in a further advantageous configuration of the invention, the at least one drive device has at least two linear motors, an increase in the adjusting force for the processing tool is obtained, as a result of which the latter can be traversed even more quickly. The advantages of such linear motors, in addition to their extremely high traversing speeds, lie in particular in the small construction space, a factor which is especially important for the present application.

A workpiece-surface processing apparatus is specified in claim 8.

With the manipulating device provided in this case, it is possible to orient the processing head according to the invention in many different directions relative to the workpiece to be machined, which enables a wide variety of workpieces to be processed.

A workpiece-surface processing method having the workpiece-surface processing head according to the invention is specified in claim 12.

Further advantageous configurations and developments of the invention follow from the remaining subclaims and from the exemplary embodiments described below in principle with reference to the drawing, in which:

DETAILED DESCRIPTION

Figure 1:
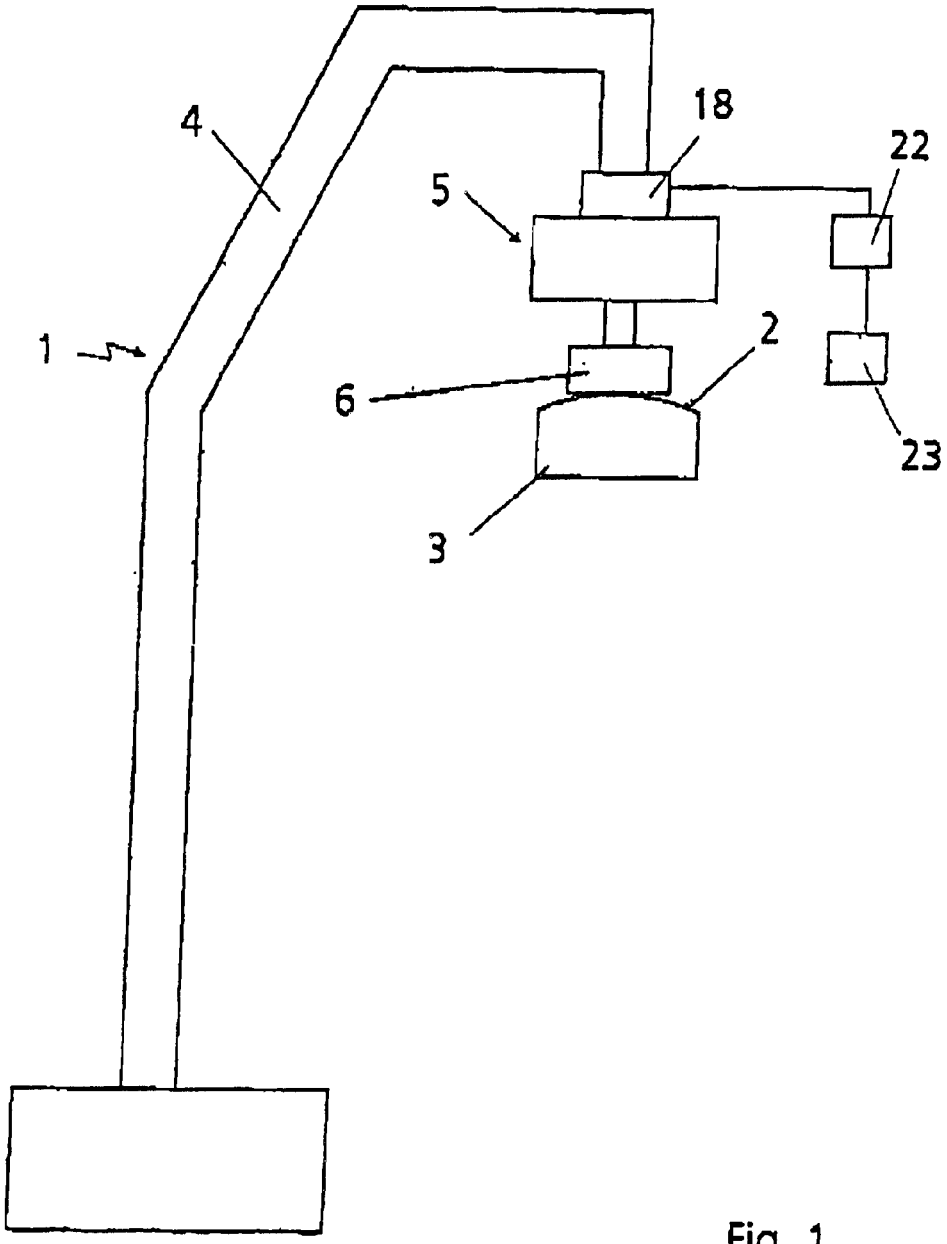
FIG. 1 shows a surface processing apparatus according to the invention with a manipulating device and, attached thereto, a processing head according to the invention, in schematic representation.

An apparatus 1 for processing a surface 2 of a workpiece 3 has a manipulating device 4 (shown in a highly schematic form), to which a workpiece-surface processing head or processing head 5 is attached.

The manipulating device 4 may be, for example, a six-axis robot known per se, which can orient the processing head 5 in the x, y and z directions and can additionally rotate it in three axis directions. The workpiece 3 is preferably a glass lens or a mirror for a lithographic system (not shown) for semiconductor lithography. The workpiece 3 may also be made of a crystal material, in particular if the workpiece 3 is a lens. In principle, any polishable material, that is to say even calcium fluoride for example, is a suitable material for the workpiece 3. The surface 2 of the workpiece 3 is designed in particular to be aspherical and has a requisite dimensional accuracy of less than 1 $\mu$m. The processing steps carried out on the workpiece 3 up to the moment when the processing head 5 is used are known per se and are therefore not explained in more detail below. The task of the processing head 5 is the fine polishing of the surface 2 of the workpiece 3, which constitutes the final processing of the workpiece 3 and is intended to provide for a very small micro-roughness of the surface 2.

Figure 2:
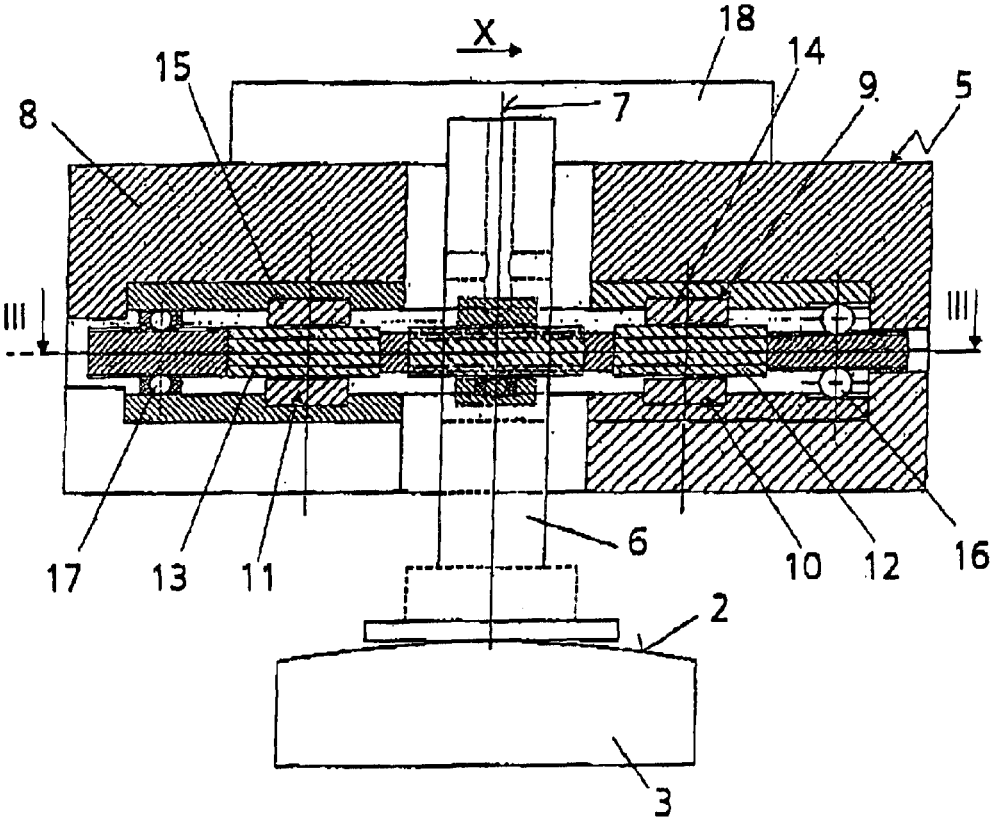
FIG. 2 shows a sectional representation of the processing head from FIG. 1.

The processing head 5 shown in section in FIG. 2 has a polishing layer or generally a processing tool 6 with a longitudinal axis 7 which runs essentially perpendicularly to the surface 2 of the workpiece 3. The tool 5 is accordingly oriented relative to the workpiece 3 by the manipulating device 4. The processing tool 6 itself may be of a type of construction known per se and may also be exchanged when the workpiece 3 to be processed is correspondingly changed.

Arranged in a housing 8, also referred to as holder, of the processing head 5 is a drive device 9 which acts in the direction of the arrow X, that is to say in the x direction, and in the present case has two electronically coupled linear motors 10 and 11 acting in the same direction. The drive device 9 is able to adjust or traverse the processing tool 6 perpendicularly to its longitudinal axis 7, which is effected by secondary parts 12 and 13, coupled to the processing tool 6, of the linear motors 10 and 11. In a manner known per se, the secondary parts 12 and 13, when appropriately activated or energized, are displaced relative to their primary parts 14 and 15 and are in addition mounted inside the housing 8 in bearing devices 16 and 17, which in the present case are designed as ball bearings.

Due to the high traversing speed of the linear motors 10 and 11, it is possible to traverse the processing tool 6 in the x direction within the shortest time and to achieve in this way a very high traversing speed, which of course constitutes the cutting speed for the processing of the surface 2 of the workpiece 3. In this way, in particular when polishing glass surfaces, more or less random processing of the surface 2 is achieved by varying the activation of the drive device 9. Such activation is achieved by a displacement transducer 18, which transmits corresponding signals to the drive device 9.

Figure 3:
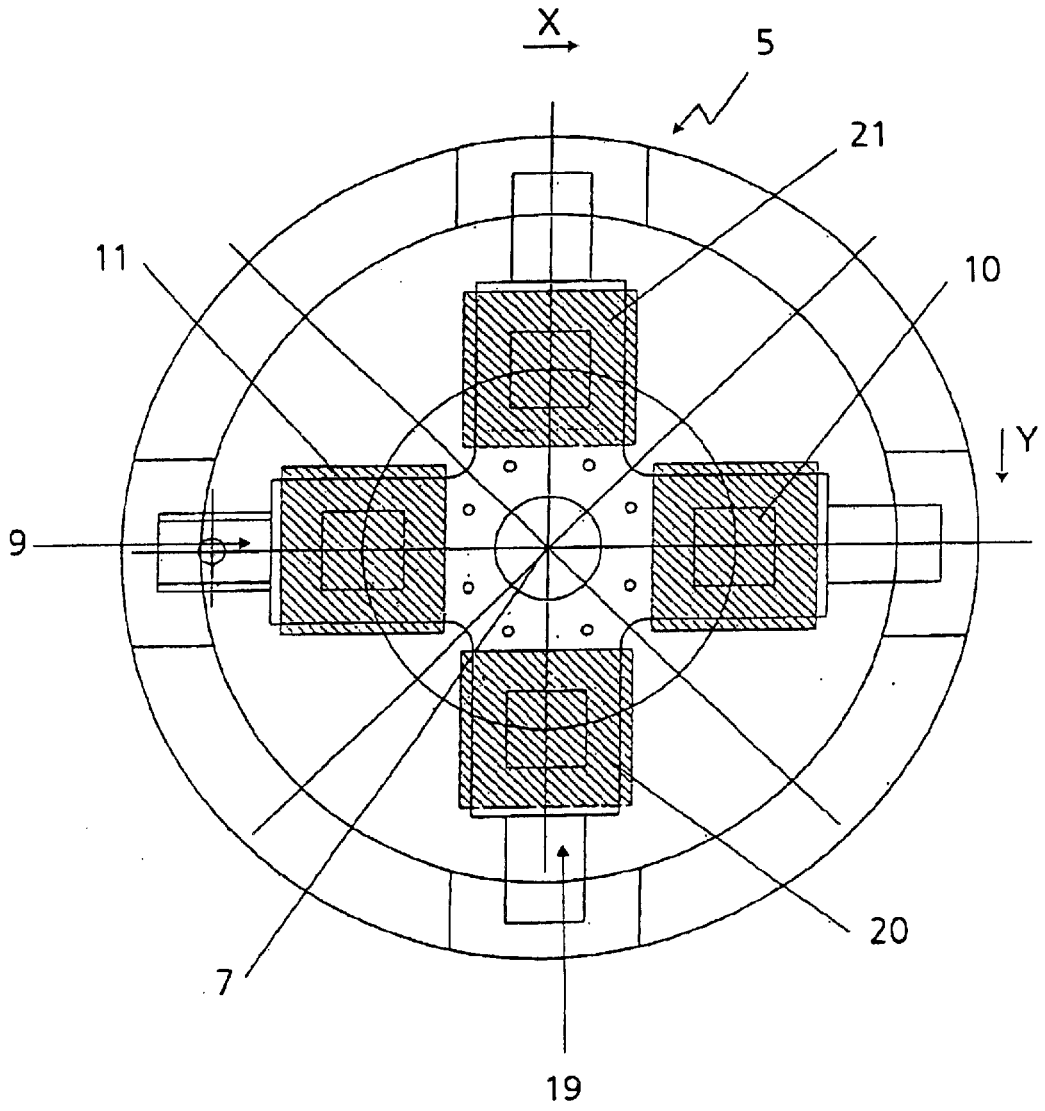
FIG. 3 shows a section along line III—III from FIG. 2.

In order to obtain a traverse of the processing tool 6 in a plane perpendicular to its longitudinal axis 7, a second drive device 19, which is shown in FIG. 3, is provided. The second drive device 19 acts in the direction of the arrow Y, that is to say in the y direction, and thus both perpendicularly to the longitudinal axis 7 of the processing tool 6 and perpendicularly to the direction of movement of the first drive device 9.

The second drive device 19 also has two linear motors 20 and 21, which in the present case are designed to be identical to the two linear motors 10 and 11 of the first drive device 9 and are therefore likewise electronically coupled to one another. In addition, the linear motors 20 and 21 also have corresponding secondary parts, primary parts and bearing devices, which, however, are not shown in any more detail. In this way, by means of the drive device 19 acting in the y direction, together with the first drive device 9 acting in the x direction, a movement of the processing tool 6 within a complete plane is possible.

The displacement transducer 18 is activated via a control device 22, indicated in FIG. 1, and via a computer device 23, said control device 22 and computer device 23 also activating the manipulating device 4. It is thereby possible to traverse the processing tool 6 in any desired geometries, both superimposed movements of the processing tool 6 with the manipulating device 4 and movements merely of the processing tool 6 being possible.

Figure 4:
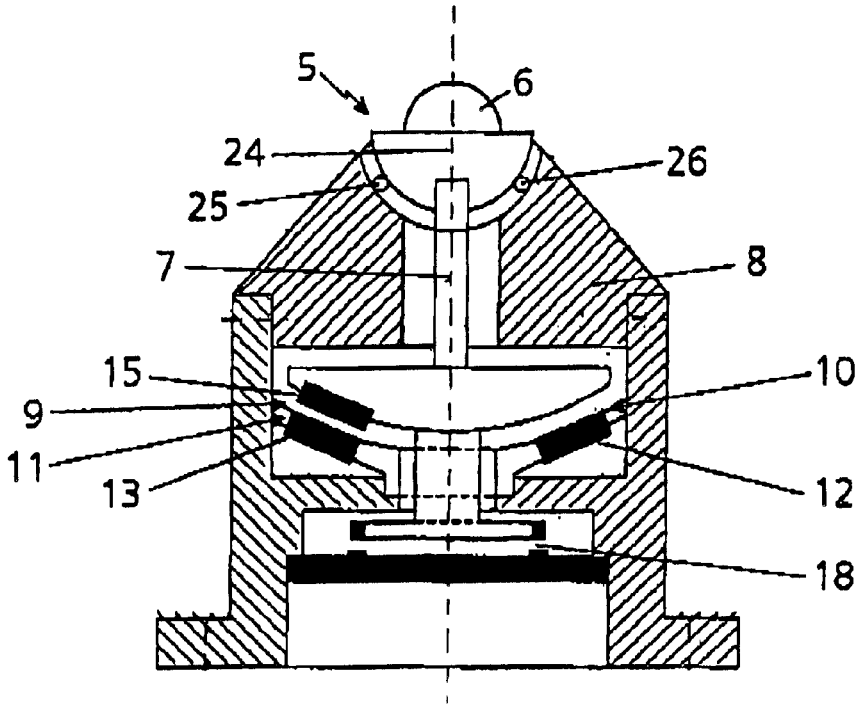
FIG. 4 shows a second embodiment of a processing head.

FIG. 4 shows a further embodiment of the processing head 5, in which the processing tool 6 is designed in the form of a ball. The spherical processing tool 6 is mounted in a spherical socket 24, which in turn is mounted relative to the housing 8 by bearings 25 and 26 and, as is the case with the processing head 5 described with reference to FIG. 2 and FIG. 3, can be moved in the x direction by means of linear motors 10 and 11. In the process, the secondary parts 12 and 13 are moved relative to the primary parts 14 and 15 likewise on a curved path. The processing tool 6 is moved in the y direction by the linear motors 20 and 21 (not shown in FIG. 4). Thus, in the embodiment according to FIG. 4, the relative speed between the surface of the workpiece 3 and the processing tool 6 is also determined by the resulting x and y speeds. In this way, a readily defined material-removal function of the tool is achieved over the entire contact area.

Since the effective contact area between the workpiece 3 and the processing tool 6 is determined by the radius of the spherical processing tool 6, which radius can be very small, very small contact areas can be achieved with the processing head 5 according to FIG. 4. This processing head 5 is therefore suitable in particular for the fine correction of high-precision mirror or lens surfaces in the extreme ultraviolet range.

A suitable material for the spherical processing tool 6 is in particular polyurethane, but any other material suitable for polishing, such as, for example, felt, may also be used. The processing tool 5 according to FIG. 4 also has the displacement transducer 18, which is arranged inside the housing 8.

Figure 5:
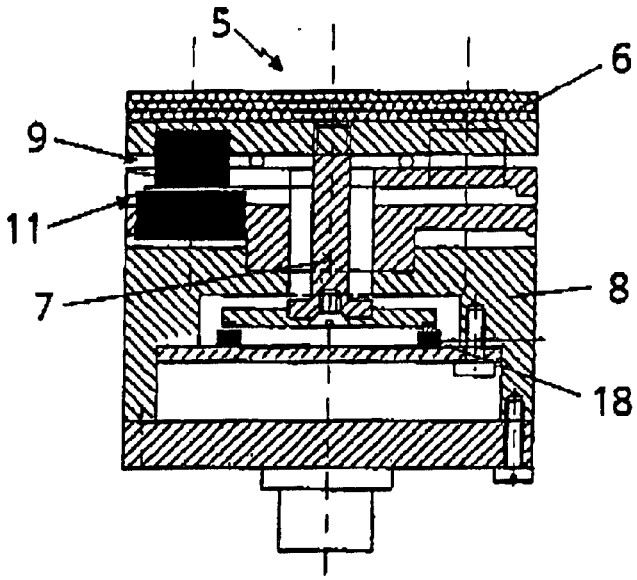
FIG. 5 shows a third embodiment of a processing head.

FIG. 5 shows a further embodiment of the processing head 5, which is of similar design to that in FIGS. 2 and 3. Here, too, elastic material is used for the processing tool 6, which, in contrast to the embodiment according to FIG. 4, is of essentially flat design, and this elastic material can be adapted to the curvature ratios of the surface of the workpiece 8 to be processed. The processing head 5 according to FIG. 5 also has the drive device 9 with the linear motors 10, 11, 20 and 21, of which, however, only the linear motor 11 is shown in FIG. 5. The displacement transducer 18 is also provided in this case.

What is claimed is:

1. A workpiece-surface processing head, having a housing and at least one processing tool which comes into contact with the surface to be processed and whose longitudinal axis is oriented essentially perpendicularly to the surface to be processed, said processing tool being traversable by at least one linear motor, the processing tool being mounted in a spherical socket, which is mounted relative to the housing by bearings moving on a curved path.

2. The workpiece-surface processing head as claimed in claim 1, wherein at least one second linear motor is provided in the processing head for moving the processing tool in a substantially perpendicular direction to a direction of the first linear motor.

3. The workpiece-surface processing head as claimed in claims 1 and 2, wherein the two linear motors are moving in the same direction and are electronically coupled to one to another.

4. The workpiece-surface processing head as claimed in claim 1, wherein the processing tool has a sphercial form.

5. The workpiece-surface processing head as claimed in claim 1, being suitable for polishing glass or ceramic surfaces.

6. A workpiece-surface processing apparatus having a manipulator and at least one processing head, attached to said manipulator, as claimed in claim 1.

7. The workpiece-surface processing apparatus as claimed in claim 6, wherein said at least one drive device of said processing head can be controlled via a computer.

8. The workpiece-surface processing apparatus as claimed in claim 7, wherein said at least one computer is coupled to at least one control device and at least one displacement transducer.

9. The workpiece-surface processing apparatus as claimed in claim 6, wherein said manipulating device is a six-axis robot.

10. A workpiece-surface processing method with a processing head as claimed in claim 1, wherein said processing tool is continuously moved by means of said at least one drive device.

* * * * *

UNITED STATES PATENT AND TRADEMARK OFFICE

CERTIFICATE OF CORRECTION

PATENT NO. : 6,951,500 B2
DATED : October 4, 2005
INVENTOR(S) : Siegfried Stacklies It is certified that error appears in the above-identified patent and that said Letters Patent is hereby corrected as shown below:

Column 2,
Line 17, reads "..... specified in claim 8." should read -- .... specified in claim 6. --.
Line 25, reads "..... specified in claim 12." should read -- .... specified in claim 10. --.

Column 4,
Line 44, reads "..... to one to another." should read -- .... to one another. --.

Signed and Sealed this

Sixteenth Day of May, 2006

JON W. DUDAS
*Director of the United States Patent and Trademark Office*